US007450071B1

(12) United States Patent
Volman

(10) Patent No.: US 7,450,071 B1
(45) Date of Patent: Nov. 11, 2008

(54) PATCH RADIATOR ELEMENT AND ARRAY THEREOF

(75) Inventor: Vladimir Volman, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 79 days.

(21) Appl. No.: 11/708,934

(22) Filed: Feb. 20, 2007

(51) Int. Cl.
*H01Q 1/38* (2006.01)

(52) U.S. Cl. ..... 343/700 MS; 343/846; 343/850

(58) Field of Classification Search ..... 343/700 MS, 343/767, 768, 770, 846, 850
See application file for complete search history.

(56) References Cited

U.S. PATENT DOCUMENTS 5,355,143 A * 10/1994 Zurcher et al. ..... 343/700 MS
6,008,763 A * 12/1999 Nystrom et al. ..... 343/700 MS
6,072,434 A * 6/2000 Papatheodorou ..... 343/700 MS
6,956,528 B2 * 10/2005 Lee et al. ..... 343/700 MS
6,995,711 B2 * 2/2006 Killen et al. ..... 343/700 MS

* cited by examiner

*Primary Examiner*—Hoang V Nguyen
(74) *Attorney, Agent, or Firm*—Duane Morris LLP

(57) ABSTRACT

An antenna element for use with an array includes an elongated slot fed from a waveguide for exciting a patch radiator. An elongated thermally conductive strip lies between the slot and the patch, and is parallel with the direction of elongation of the slot. A radome extends above the patch. In one embodiment, a thermal conductor rod extends from the thermally conductive strip to the patch, and coaxially above the patch to the radome. In a preferred embodiment, the slot is ridged and (inter) digitated near its ends. The slot is excited from stripline by means of an elongated conductive strip orthogonal to the elongation of the slot. Through vias extend through and between thin electrically conductive layers to define the waveguide and provide heat sinking.

26 Claims, 12 Drawing Sheets

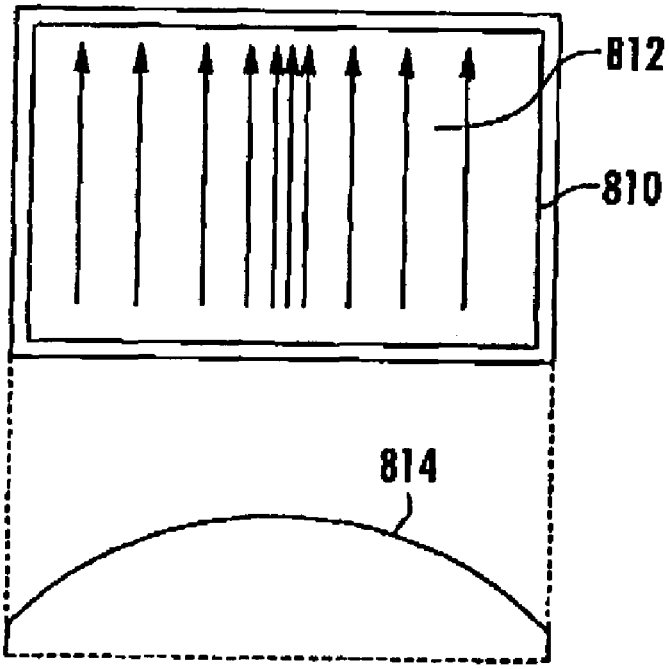
FIG. 8a
FIG. 8b
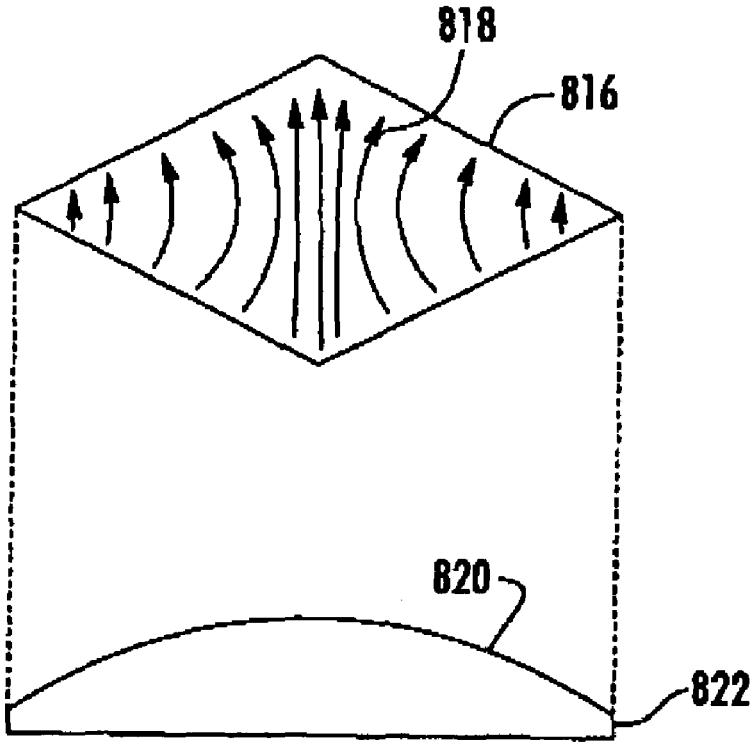
FIG. 8c
FIG. 8d

PATCH RADIATOR ELEMENT AND ARRAY THEREOF

FIELD OF THE INVENTION

This invention relates to antennas suitable for use in an antenna array, and for sinking heat from a protective radome.

BACKGROUND OF THE INVENTION

Array antennas of various types have become common for situations in which a large radiating aperture is desired, because the radiating aperture can be made up of many individual antenna elements. Array antennas are also advantageous for situations in which beam agility is desired, which is to say when the antenna beam or beams must be directed and redirected in space.

Those skilled in the arts of antenna arrays and beamformers know that antennas are transducers which transduce electromagnetic energy between unguided- and guided-wave forms. More particularly, the unguided form of electromagnetic energy is that propagating in "free space," while guided electromagnetic energy follows a defined path established by a "transmission line" of some sort. Transmission lines include coaxial cables, microstrip and striplines, rectangular and circular waveguide tubes with conductive walls, dielectric paths, and the like. Antennas are totally reciprocal devices, which have the same beam characteristics in both transmission and reception modes. For historic reasons, the guided-wave port of an antenna is termed a "feed" port, regardless of whether the antenna operates in transmission or reception. The beam characteristics of an antenna are established, in part, by the size of the radiating portions of the antenna (the "radiating aperture") relative to the wavelength. In the context of simple conductive antenna elements such as a monopole, dipole, or patch, the radiating aperture is viewed as being a region around the physical element. Small antennas make for broad or nondirective beams, and large antennas make for broad, narrow or directive beams. When more directivity (narrower beamwidth) is desired than can be achieved from a single antenna, several antennas may be grouped together into an "array" and fed together in a phase-controlled manner, to generate the beam characteristics of an antenna larger than that of any single antenna element. The structures which control the apportionment of power to (or from) the antenna elements are termed "beamformers," and a beamformer includes a beam port and a plurality of element ports. In a transmit mode, the signal to be transmitted is applied to the beam port and is distributed by the beamformer to the various element ports. In the receive mode, the unguided electromagnetic signals received by the antenna elements and coupled in guided form to the element ports are combined to produce a beam signal at the beam port of the beamformer. A salient advantage of sophisticated beamformers is that they may include a plurality of beam ports, each of which distributes the electromagnetic energy in such a fashion that different beams may be generated simultaneously.

Because of cost, available volume, and weight considerations, it is often desirable to make an array antenna in the form of a planar sheet. Fabrication on planar sheets allows simultaneous manufacture of many arrayed "patch" antenna elements by methods such as printing, application of resist, and etching. Such antenna elements tend to be subject to corrosion and breakage when exposed to the elements. Consequently, the antenna elements of an array antenna are often mounted behind a protective cover or electromagnetically transparent "radome." In the case of a planar array, the protective cover can be generally flat, so there is no need for a "dome" per se.

An array antenna, such as those used for radar purposes, may include thousands of individual antenna elements. The transmission of energy through the radome in the transmission mode of the radar tends to heat the radome, which can be disadvantageous. A radome naturally cools itself by exposure of one side to the elements. Cooling of the radome by other means is difficult, because the radome must be as transparent as possible to electromagnetic energy. Many thermally conductive elements which might be used for carrying heat away from the antenna elements and the radome are electrically conductive. Such electrically conductive materials, when located in or near the "aperture" of an antenna, tend to distort the radiation field of the antenna elements. These distortions tend to change, depending upon the direction in which the antenna beam of the array antenna is steered. This direction-dependent beam distortion makes analysis of returned signals undesirably complex.

Since the array antenna may include thousands of elemental antennas, the cost of each antenna element is an important factor in determining its suitability. An array antenna using easily-fabricated patch antennas has a radiation pattern at angles off-boresight which is the product of the pattern of an individual element and of an "array factor" which depends upon the number of elemental antennas in the array. This, in turn, means that the radiation pattern of each individual patch antenna should be spatially as broad (nondirective) as possible, so as not to adversely affect off-boresight performance of the array, and frequency-wise should tend to maintain the same beam performance over a frequency range at least as broad as that of the application to which it is directed.

Thus, the elemental antenna elements of an array are subject to limitations as far as ease of fabrication and cost, weight, off-axis directivity, heat sensitivity, and other factors such as type of feed (coax or hollow waveguide) and impedance match to the associated transmission line.

Improved or alternative array antenna elements and arrays are desired.

SUMMARY OF THE INVENTION

An antenna according to an aspect of the invention comprises a first generally planar conductive piece defining a feed aperture, and a second generally planar conductive piece defining an elongated slot. The first and second generally planar pieces are spaced apart and electrically conjoined, as by a set of through vias, along a closed path. A feed strip lies between the first and second generally planar conductive pieces and extends to the feed aperture for being fed thereat, to thereby define a stripline. The direction of elongation of the feed strip extends orthogonal to the direction of elongation of the slot for exciting the slot and generating an electric field thereacross. A generally planar conductive third layer defines an elongated strip. The conductive third layer is mounted adjacent the slot, and spaced therefrom, with the direction of elongation of the strip parallel with the direction of elongation of the slot. A generally planar patch antenna is mounted near the conductive strip, with the plane of the patch antenna parallel with the planes of the first and second generally planar conductive pieces. A radome is located adjacent to, but not necessarily in contact with, the patch antenna. A thermally conductive rod extends from the conductive strip toward and through the patch antenna, and extends above the patch antenna by an amount selected to make contact with the radome. In one embodiment, the elongated strip of the third layer is thermally conductive, and in another, embodiment, the elongated strip of the third layer is electrically conductive. In a preferred embodiment, the elongated strip of the third layer is both thermally and electrically conductive. The radome may be supported away from the patch antenna by a dielectric element. In a version preferred for bandwidth, the elongated slot in the second generally planar conductive piece is ridged. For broadbanding, the elongated slot in the second generally planar conductive piece is digitated or interdigitated. In general, the digitation or interdigitation is near an end of the slot, and preferably near both ends of the slot, and remote from the center region of the slot.

An antenna according to another aspect of the invention comprises a generally planar electrically conductive patch radiator defining a radiating side and an other side, and a generally planar electrically conductive layer adjacent, but not contacting, the other side. The electrically conductive layer defines an elongated aperture, for exciting the patch radiator with linearly polarized energy. A radome is juxtaposed with the radiating side of the patch radiator. A thermally conductive, planar layer extends generally parallel with the patch radiator and the electrically conductive layer at a location lying between the patch radiator and the electrically conductive layer, and not in contact with either the patch radiator or the electrically conductive layer. The thermally conductive layer includes an elongated strip thermal conductor extending parallel with the elongated aperture, and in thermal communication with a heat sink. An elongated thermally conductive member extends perpendicular to the plane of the patch radiator, and defines first and second ends. The first end of the thermally conductive member is in thermal communication with the strip conductor of the thermally conductive planar layer. The thermally conductive member extends through the patch radiator, and has the second end of the thermally conductive member in thermal contact with the radome. In a particular embodiment of this embodiment, the thermally conductive member is a rod. In another hypostasis of the invention, the antenna further comprises a hollow waveguide attached to the electrically conductive layer, for feeding the patch radiator from the elongated aperture. The planar patch radiator is generally rectangular, and more specifically may be generally diamond-shaped. The radome may be in actual contact with the patch radiator, or may be separated from the patch radiator by at least one layer of foam dielectric material. The elongated aperture in the generally planar electrically conductive layer defines first and second straight, elongated, mutually parallel sides, and in a broadband version the elongated aperture further defines at least one digitation in which a first digit protrudes from one of the first and second straight, elongated, mutually parallel sides toward the other one of the first and second straight, elongated, mutually parallel sides. The one digitation of the elongated aperture may lie adjacent a first end of the elongated aperture. The elongated aperture may further define a second digitation in which a finger protrudes from the one of the first and second straight, elongated, mutually parallel sides toward the other one of the first and second straight, elongated, mutually parallel sides adjacent a second end of the elongated aperture. In yet a further version, the one digitation in which a first digit protrudes from one of the first and second straight, elongated, mutually parallel sides toward the other one of the first and second straight, elongated, mutually parallel sides includes a further digit protruding from the other one of the first and second straight, elongated, mutually parallel sides toward the one of the first and second straight, elongated, mutually parallel sides at a location lying adjacent the first digit, to thereby define an interdigitation. This interdigitation lies near an end of the elongated aperture. In a second avatar of this aspect of the invention, a second interdigitation lies near an other end of the elongated aperture.

An array antenna according to another aspect of the invention includes a generally side-by-side array of antenna elements, each of which antenna elements comprises:

a first generally planar conductive piece defining a feed aperture, and a second generally planar conductive piece defining an elongated slot. The first and second generally planar pieces are spaced apart and electrically conjoined. A feed strip lies between the first and second generally planar conductive pieces and extends to the feed aperture for being fed thereat. The feed strip extends orthogonal to the slot for generating an electric field across the slot. A generally planar conductive third layer defines an elongated strip. The conductive third layer is mounted adjacent the slot, and spaced therefrom, with the direction of elongation of the strip parallel with the direction of elongation of the slot. A generally planar patch radiator is mounted near, but not in contact with, the conductive strip, with the plane of the patch radiator parallel with the planes of the first and second generally planar conductive pieces. A radome is located adjacent to, but not necessarily in contact with, the patch radiator. A thermally conductive rod extends from the conductive strip toward and through the patch radiator, and extending above the patch radiator by an amount selected to make contact with the radome.

In this array antenna, (a) the first generally planar conductive piece, (b) the second generally planar conductive piece, (c) the generally planar conductive third layer, and (d) the radome are common to all antenna elements of the array.

An antenna according to a further manifestation of the invention comprises a generally planar electrically conductive patch radiator defining a radiating side and an other side, and also comprises a generally planar electrically conductive layer adjacent, but not contacting, the other side of the patch radiator. The electrically conductive layer defines an elongated aperture, for exciting the patch radiator with energy flowing through the elongated aperture in the electrically conductive layer. The elongated aperture defines first and second generally straight, mutually parallel sides and first and second ends. The elongated aperture further defines digitation adjacent at least the first end of the elongated aperture. The digitation includes a first finger extending from the first side of the elongated aperture toward the second side of the elongated aperture, but not making contact with the second side of the elongated aperture. In a particular version of this manifestation, the digitation is part of an interdigitation. The interdigitation further includes a second finger extending from the second side of the elongated aperture toward the first side of the elongated aperture, but not making contact with the first side of the elongated aperture. The first and second fingers lie adjacent each other.

BRIEF DESCRIPTION OF THE DRAWING

FIG. 8*a* illustrates the electric field distribution in an aperture with conductive walls, and FIG. 8*b* is a corresponding distribution, FIG. 8*c* illustrates the electric field distribution in a diamond-shaped aperture with conductive walls, and FIG. 8*d* is the corresponding distribution;

DESCRIPTION OF THE INVENTION

Figure 1:
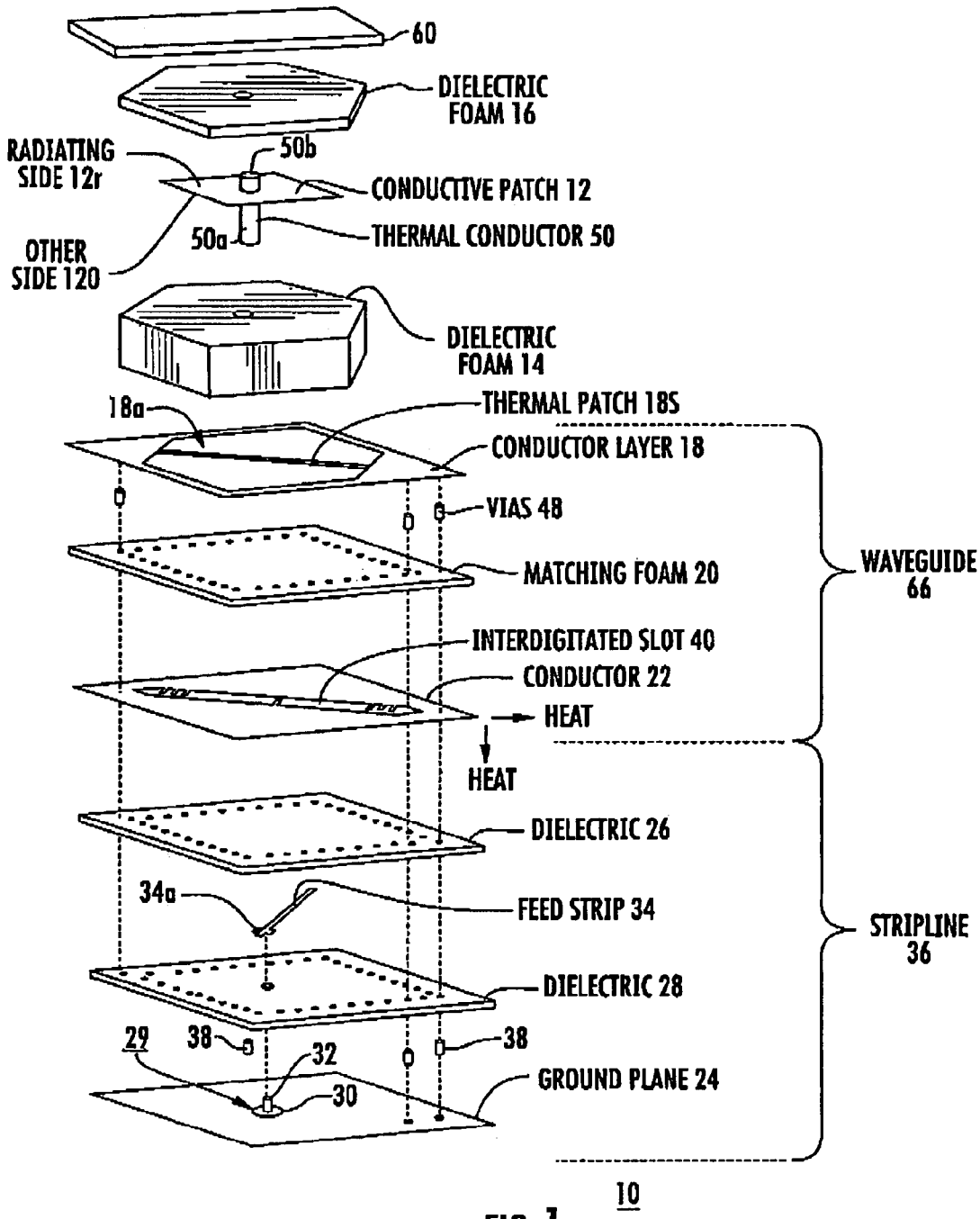
FIG. 1 is an exploded, perspective or isometric, view of a single antenna element according to an aspect of the invention.

FIG. 1 is an exploded, perspective or isometric, view of a single antenna element 10 according to an aspect of the invention. Antenna 10 of FIG. 1 is but one of a plurality of antenna elements of an array. In FIG. 1, a thin, electrically conductive, generally rectangular, rhombic, or "diamond-shape" patch 12 is supported by a low-dielectric-constant (low $\epsilon$) slab or piece of dielectric foam material. The electrical conductor may be copper. The dielectric foam piece 14 is illustrated as having a projected hexagonal shape, but it will be understood that the foam support piece 14 may be part of a continuous layer or slab of support foam which extends to support the patch antenna elements of adjacent antennas similar to antenna 10. Alternatively, the projected shape of the foam piece 14 may be circular or any other convenient shape. Thus, patch antenna element 12 is held above foam piece or slab 14.

The description herein includes relative placement or orientation words such as "top," "bottom," "up," "down," "lower," "upper," "horizontal," "vertical," "above," "below," as well as derivative terms such as "horizontally," "downwardly," and the like. These and other terms should be understood as to refer to the orientation or position then being described, or illustrated in the drawing(s), and not to the orientation or position of the actual element(s) being described or illustrated. These terms are used for convenience in description and understanding, and do not require that the apparatus be constructed or operated in the described position or orientation. Terms concerning mechanical attachments, couplings, and the like, such as "connected," "attached," "mounted," refer to relationships in which structures are secured or attached to one another either directly or indirectly through intervening structures, as well as both movable and rigid attachments or relationships, unless expressly described otherwise.

A further low dielectric foam support piece 16 is mounted atop or supported by foam piece 14 in FIG. 1, and sandwiches the thin patch element 12 for support thereof. Foam support piece 14 is, in turn, mounted on or supported by a thin layer 18 of electrically conductive material, such as copper. A further dielectric slab or piece 20 supports patch antenna element 12 and conductor layer 18 above an electrically conductive layer 22. Electrically conductive layer 22 is in turn supported above a thin, electrically conductive ground plane 24 by a stack including further layers 26 and 28 of dielectric material. As illustrated in FIG. 1, a coaxial feed 29 is affixed to the ground plane conductor 24, and includes an outer conductor (not separately visible in FIG. 1) in electrical contact with the periphery of an aperture 30 defined in the ground plane 24, so that the outer conductor is in contact with the ground plane. The coaxial feed 29 also includes a center conductor 32, which extends above the upper surface of the ground plane 24. A strip feed conductor 34 defining an aperture 34*a* is sandwiched between dielectric layers 26 and 28, and its aperture 34*a* lies in-line with protruding center conductor 32. Strip conductor 34 is open-circuited in that its end remote from the feed aperture 34*a* makes no connection to any of the conductive layers of antenna element 10. However, radio-frequency (RF) currents can flow in strip 34 as a result of its coupling to ground plane 24 and conductor 22.

Strip conductor 34 of FIG. 1 is located in a stripline-like structure designated generally as 36 including spaced-apart mutually parallel conductors 22 and 24. The edges of the stripline structure 36 are defined by a plurality of electrically conductive through vias, well known in the art, illustrated as pins, some of which are designated 38. The pins or vias 38 make electrical and thermal contact with ground plane conductor 24, and extend through dielectric pieces 26 and 28 to make contact with conductive piece 22. The locations at which the vias 38 extend through dielectric slabs 26 and 28 are indicated by dots extending around the peripheries of the dielectric slabs. It must be remembered that the dielectric slabs may extend "indefinitely" to the sides, and are not required to have defined edges as illustrated in FIG. 1. Consequently, as illustrated in FIG. 1, the locations at which the vias 38 extend through the dielectric slabs 26 and 28 define a rectangular or rhombic open-ended stripline 36, and the "edges" of the dielectric pieces or slabs 26 and 28 have no actual meaning, at least in principle.

Figure 2A:
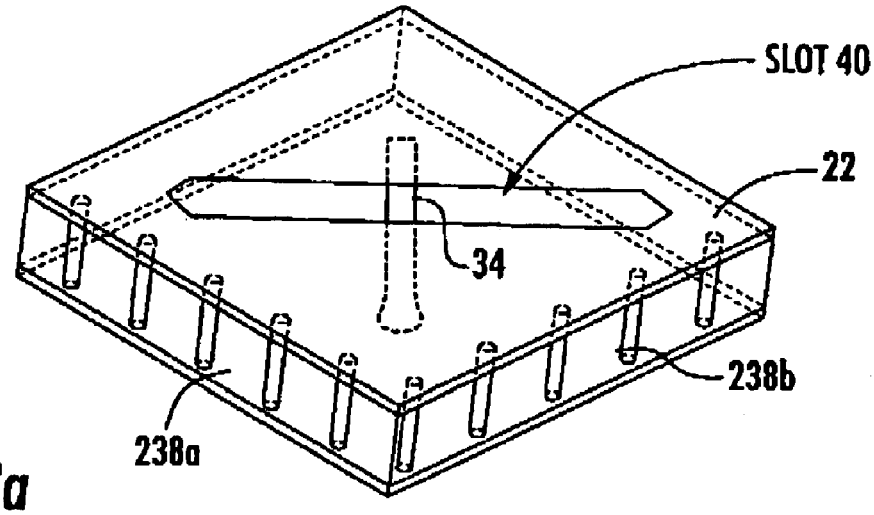
FIG. 2*a* is a simplified notional view of the upper side of a stripline portion of the antenna element of FIG. 1.
Figure 2B:
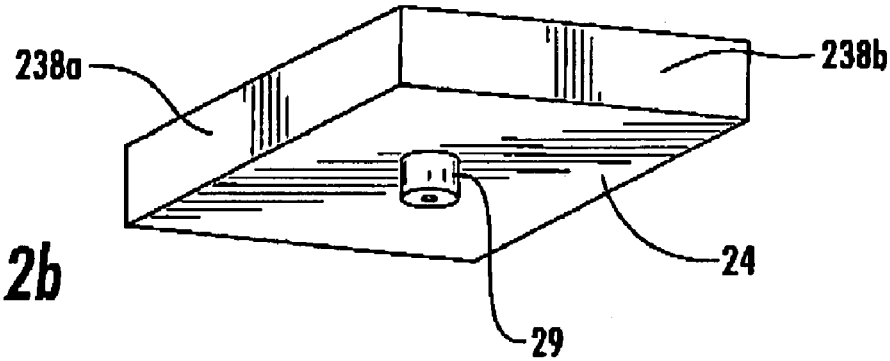
FIG. 2*b* is a simplified notional view of the under side thereof.

To aid in understanding the stripline structure 36 of FIG. 1, FIG. 2*a* is a simplified notional view of the upper side thereof, and FIG. 2*b* is a simplified notional view of the under side thereof. In FIG. 2*a*, the stripline section 36 includes sides 238*a* and 238*b*, which are defined by the through vias 38 of FIG. 1. The upper conductive layer 22 acts as a first or upper ground plane of the stripline 36, and also acts as a lower conductive plane of a hollow conductive waveguide 66, visible in FIG. 1. Upper conductive layer 22 of FIGURES 1 and 2*a* also defines a coupling or impedance matching slot 40, the long dimension of which extends in a direction orthogonal or at right angles to the direction of elongation of strip conductor 34. FIG. 2*b* illustrates the under side of the stripline structure 36, showing the lower ground plane 24 and a coaxial connector 29. The coaxial connector 29 is intended to represent any unbalanced feed, such as an actual coaxial transmission line, or a through via (not illustrated) from a strip conductor of a further strip transmission line (not illustrated) lying below conductive layer 24.

Figure 3A:
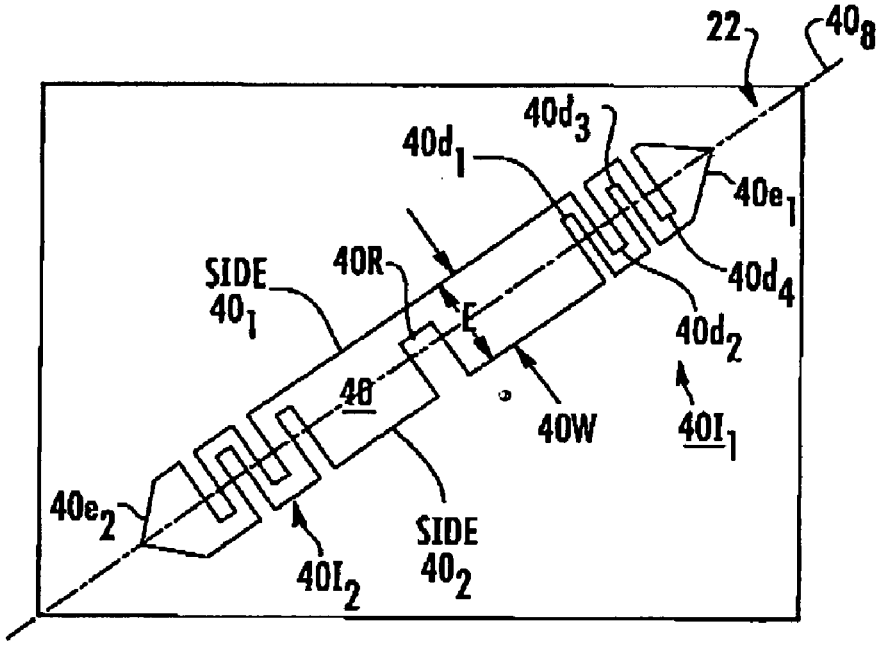
FIG. 3*a* is a plan view of a conductive layer of the structure of FIG. 1, showing interdigitation of a slot for broadbanding the stripline coupling.

Those skilled in the art will recognize that the electric fields generated across slot 40 of FIG. 1 extend in the direction of elongation of strip conductor 34. FIG. 3*a* is a plan view of conductive layer 22 of FIG. 1, showing a "ridge" and "interdigitation" for broadbanding the coupling from the waveguide or cavity 36. In FIG. 3*a*, slot 40 in layer 22 extends diagonally, and has a nominal width 40W. Slot 40 as illustrated defines a structure 40R which those familiar with waveguides will recognize as a ridge, centered between the ends $\mathbf{40}e_1$ and $\mathbf{40}e_2$ of slot 40. Ridge structure 40R can extend from side $\mathbf{40}_2$ toward side $\mathbf{40}_1$ as illustrated, or it can extend from side $\mathbf{40}_2$ toward side $\mathbf{40}_1$, or each side can have a ridge structure which extends toward the ridge structure of the other side. Slot 40 as illustrated in FIG. 3*a* is also interdigitated, in that, at locations near ends $\mathbf{40}e_1$ and $\mathbf{40}e_2$ of slot 40, a plurality of interleaved digits of digit sets 40I1 and 40I2, respectively, extend from each side of the slot toward the other side. Set 40I1 of digits adjacent end 40*e* of slot 40 is illustrated as including digits 40*d*1, 40*d*2, 40*d*3, and 40*d*4, extending alternately from sides $\mathbf{40}_1$ and $\mathbf{40}_2$ of the slot 40. In the illustrated pattern, digits 40*d*1 and 40*d*3 extend from a first side toward the second, without touching the second side, and digits 40*d*2 and 40*d*4 extend from the second side toward the first, again without touching the first side. A similar set 40I2 of digits extends from each side of slot 40 near end 40*e*2. If the digits of sets 40I1 or 40I2 were to touch the sides of slot 40 toward which they extend, they would short-circuit the slot, and decrease its effective length. Since they do not touch the opposite sides, these interleaved digits provide additional capacitance between the two sides of slot 40. At comparatively low frequencies, the additional capacitance exhibits a relatively large reactance, and the full physical length of the slot is available as electrical length. At relatively higher frequencies, the interleaved digits exhibit a relatively low reactance, thereby tending to shorten the effective length of the slot. Thus, the effective slot length can be viewed as tending to be constant over a range of frequencies. Both the use of a ridge and the use of capacitive digits tend to broadband the coupling of slot 40. The instantaneous electric field direction across a slot 40 is illustrated by arrow E.

Figure 3B:
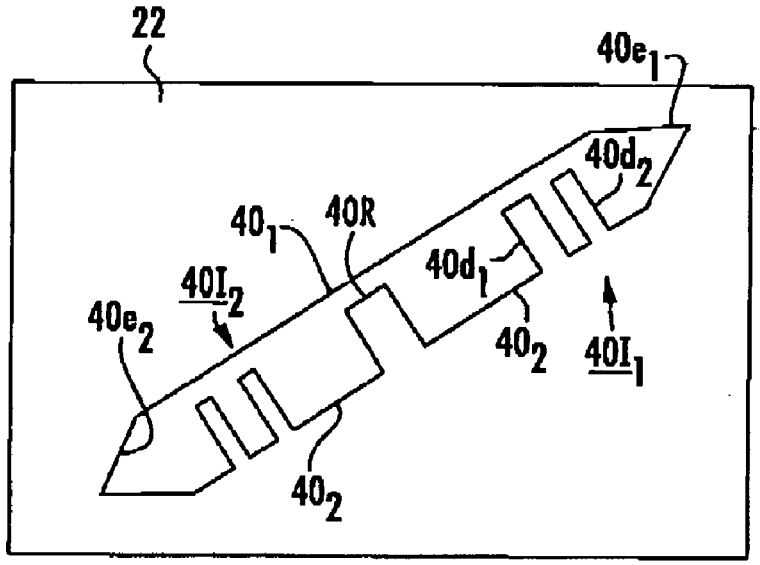
FIG. 3*b* is similar to FIG. 3*a*, but showing only digitation.
Figure 3C:
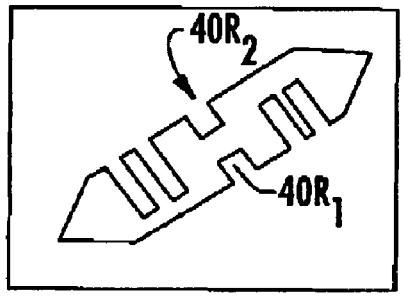
FIG. 3*c* shows digitation from alternate sides of the slot, and also showing an alternate ridge arrangement.

FIG. 3*b* illustrates an alternative digitation scheme for slot 40 of FIG. 1. In FIG. 3*b*, the slots of set 40I1 extend only from side $\mathbf{40}_2$ of slot 40 toward side $\mathbf{40}_1$. This arrangement produces less capacitance than the arrangement of FIG. 3*a*, and may be advantageous under some conditions. FIG. 3*c* illustrates digits extending from alternate sides of the slot, without interdigitation. FIG. 3*c* also illustrates a ridge structure $\mathbf{40}R_1$, $\mathbf{40}R_2$ in which the ridge portions extend toward each other.

Figure 4:
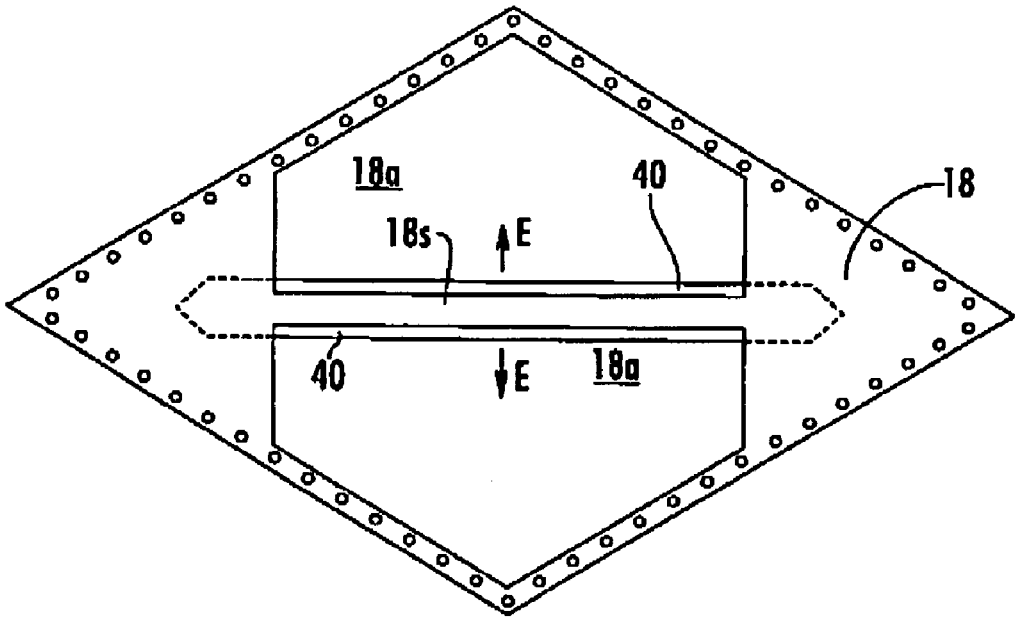
FIG. 4 is a notional plan view illustration of slot of FIG. 3, the electric field direction E, and the orientation of a strip conductor of FIG. 1.

In FIG. 1, conductive layer 18 is supported above waveguide or cavity 36 by a layer 20 of dielectric. Conductive layer 18 is electrically connected to conductive layer 22 by a set 48 of a plurality of through vias. Conductive layer 48 defines an aperture 18*a*. The set 48 of vias may be viewed as a foreshortened rectangular hollow waveguide 66 for coupling electromagnetic waves between slot 40 and aperture 18*a*. Aperture 18*a* in conductive layer 18 is hexagonal, and is bisected by a strip conductor or thermal path 18*s*, which extends from one flat side of the hexagon aperture to a diametrically opposite flat side. As illustrated, the axis of elongation of strip 18*s* is orthogonal to the direction of the electric field generated across slot 40 (parallel to the direction of elongation of slot 40). FIG. 4 is a notional plan view illustration of slot 40, the electric field direction E, and the orientation of strip conductor 18*s*. The direction of elongation of strip conductor 18*s* is orthogonal to the direction of electric field E produced across slot 40. This orientation of strip conductor 18*s* tends to short-circuit or reflect any polarization of electromagnetic field other than in the direction of field E.

In a transmitting mode of the antenna element 10 of FIG. 1, the electric field E generated across slot 40 propagates from stripline 36, through slot 40, and past elongated conductor 18*s*. As is well known to those in the art, an open-ended hollow waveguide is fully capable of "radiation," or acting as an antenna. Thus, in the absence of other structures, the arrangement including stripline 36 and waveguide 66 of FIG. 1 is capable of acting as an antenna element. However, it has been found that the direct application of open or hollow waveguides in an array tends toward excessive mutual coupling between antenna elements. This mutual coupling can adversely affect the array performance, especially when it is desired to scan the array beam(s) away from broadside. In order to tend to reduce mutual coupling between adjacent antenna elements when arrayed, the waveguide 66 of FIG. 1 excites a conductive patch antenna element 12. Patch antenna 12 radiates in known fashion to produce the desired field. When in operation in an array of patch antennas such as 10, the phases of the signals applied to the feed strips 34 are controlled to produce an antenna beam or beams in the desired direction.

In order to tend to further reduce the coupling between adjacent antenna elements of an array of the antenna elements of FIG. 1, the patch antenna shape is selected to tend to equalize the "E-" and "H-" plane field distributions across the aperture.

As illustrated in FIG. 1, a generally planar radome 60 extends over the patch antenna 12 and its foam layer 16. The radome also extends over similar adjacent ones of the antenna elements of an array. A thermally conductive rod 50 transfixes patch 12, and has a length selected to make contact with the lower side of radome 60 and with the upper side of strip conductor 18*s*. This provides a thermally conductive path extending from the radome 60, through rod 50 to thermally conductive strip 18*s*, and through strip 18*s* to the more extensive layer 18 of thermally conductive material. This thermal conduction path has little effect on the electric field, because strip conductor 18*s* is orthogonal to the E field direction, and the direction of elongation of rod 50 is also orthogonal to the electric field direction E. Thus, the antenna element 10 provides heat sinking of the radome with little effect on the electric field configuration.

According to an aspect of the invention, the dielectric constants of dielectric layers 14 and 16 are selected in conjunction with the dielectric constant of layer 26 to provide impedance matching from the stripline 36 to free space. In a particular application, the dielectric constant of layers 14 and 16 is selected to be $\epsilon$=1.9 or less, the dielectric constant of dielectric layer 20 is selected to be somewhat higher, in the vicinity of $\epsilon$=3.0, to aid in matching the slot 40 to the patch antenna. Dielectric layers 26 and 28 are selected to have intermediate dielectric constant, namely in the vicinity of $\epsilon$=2.2.

Figure 5:
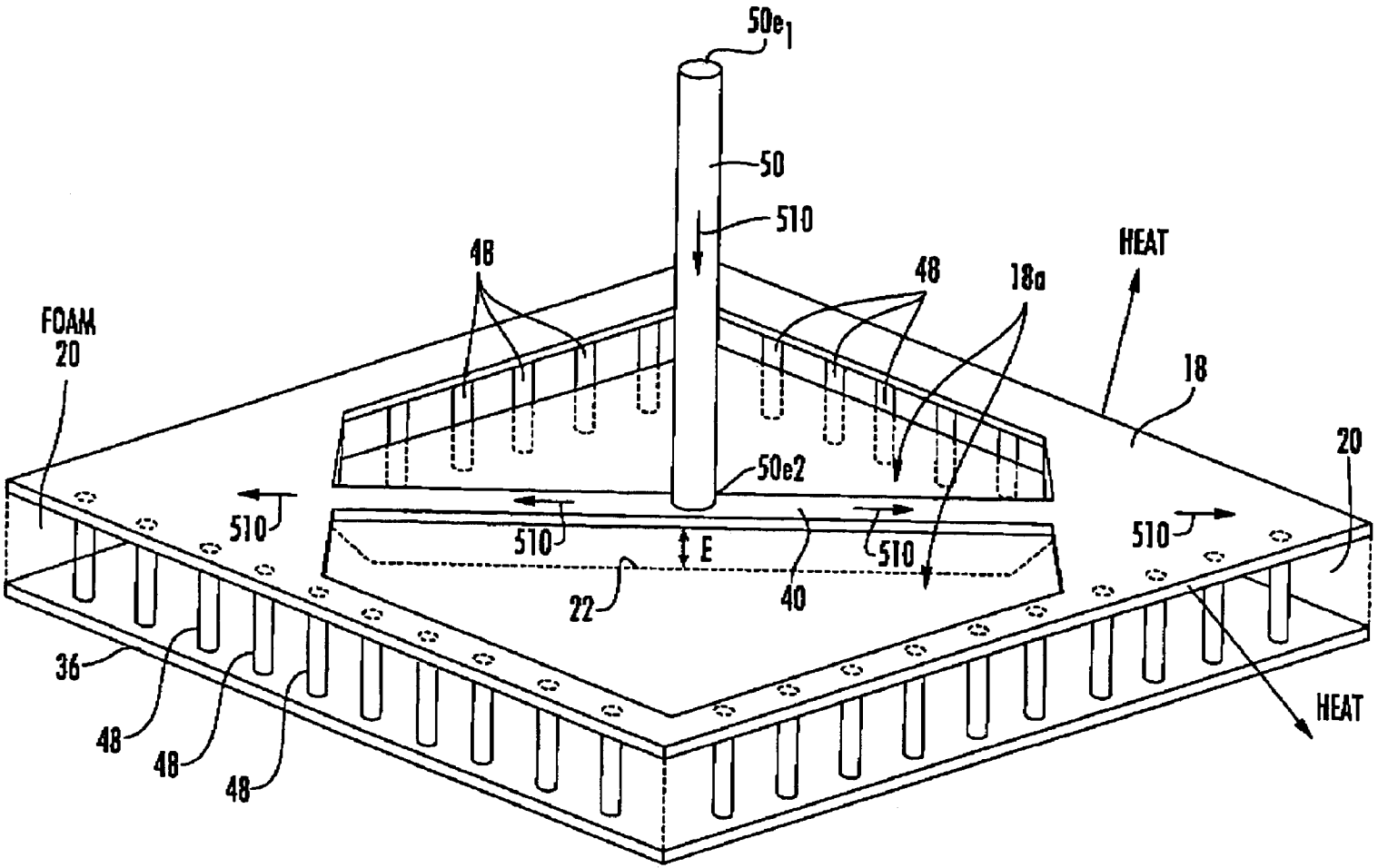
FIG. 5 is a perspective or isometric notional view of the slot of FIG. 2 and the waveguide of FIG. 1, and including a dielectric layer, the strip conductor of FIG. 4, and a thermal rod.

FIG. 5 is a perspective or isometric view of a portion of the structure of FIG. 1, showing the path for heat flow from the radome to metal layer 18. As illustrated in FIG. 5, the heat flow is indicated by arrows 510. The heat flows in rod 50, and through strip conductors 40 to the main portion of conductive layer 18. From conductive layer 18, the heat can flow transversely (toward the right and left in FIG. 5) toward adjacent antenna elements, and can also flow vertically through the conductive vias 48 to the layers of the stripline 36. It will be understood that the stripline 36 of FIG. 5 is illustrated in its collapsed form, and that other portions of the antenna element are expanded in the vertical direction for improved clarity of explanation.

Figure 6:
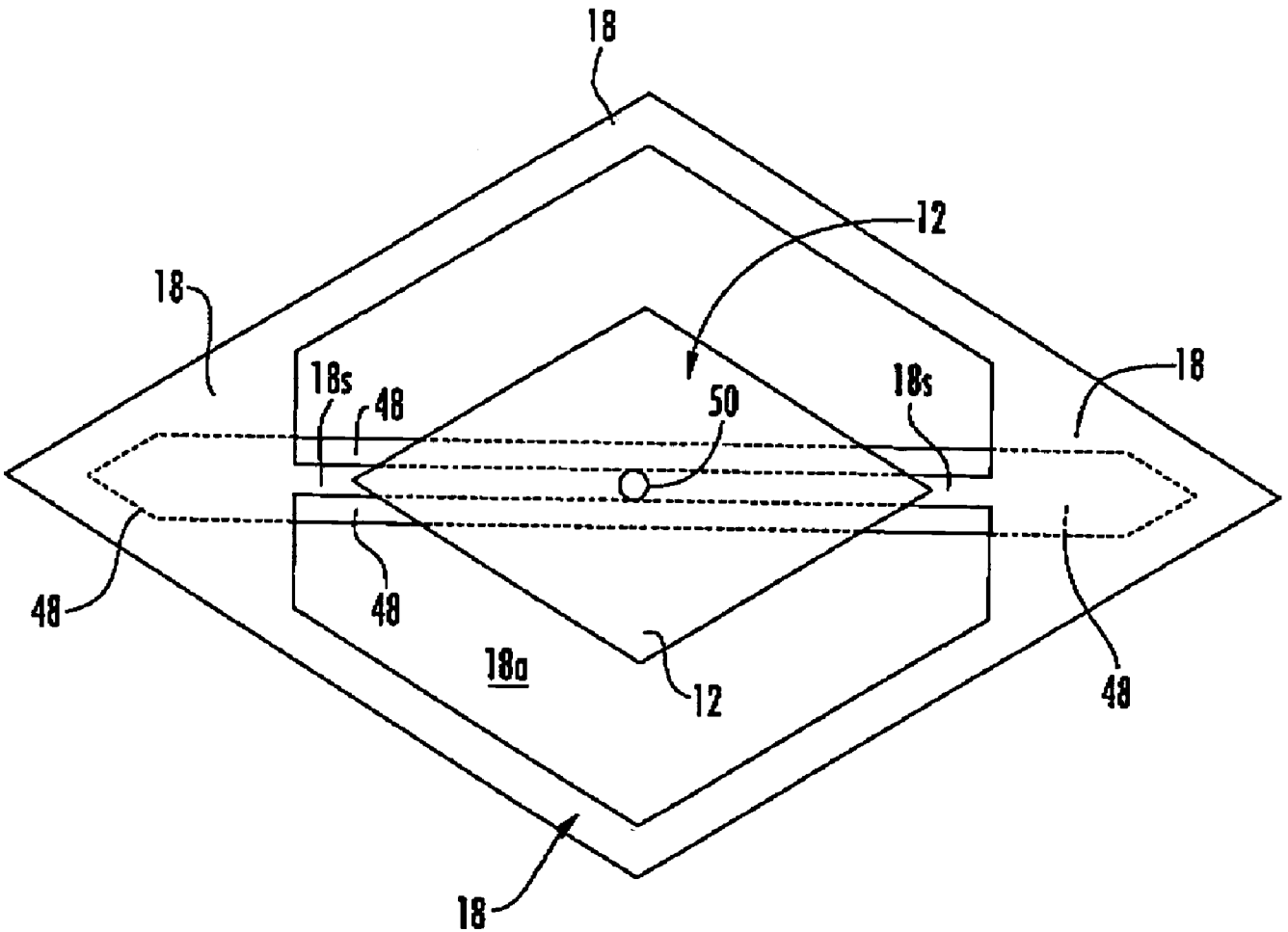
FIG. 6 is a plan view of an antenna element according to an aspect of the invention, showing the diamond shape of the patch.

FIG. 6 is a plan view, partially in cross-section, of an antenna element according to an aspect of the invention. In FIG. 6, elements corresponding to those of FIGS. 1, 2*a*, 2*b*, 3*a*, 4, and 5 are designated by like reference alphanumerics. FIG. 6 shows that the patch 12 is not necessarily square, but rather may be rhombic or in the form of a parallelogram, which form is termed a "diamond" shape in consonance with the term for the symbol ordinarily used on playing cards. Aperture 18*a* may be hexagonal.

Figure 7A:
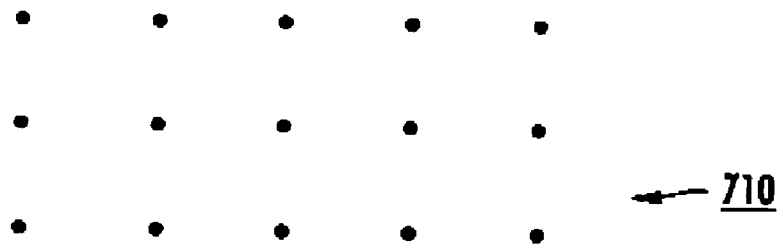
FIG. 7*a* illustrates a regular rectangular array.
Figure 7B:
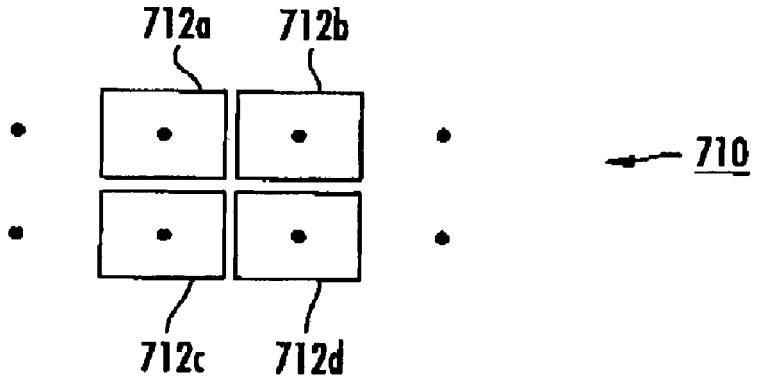
FIG. 7*b* illustrates rectangular horns or apertures centered on the elements of the array of FIG. 7*a*.
Figure 7C:
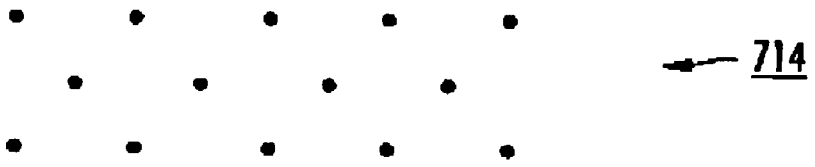
FIG. 7*c* illustrates a staggered array.
Figure 7D:
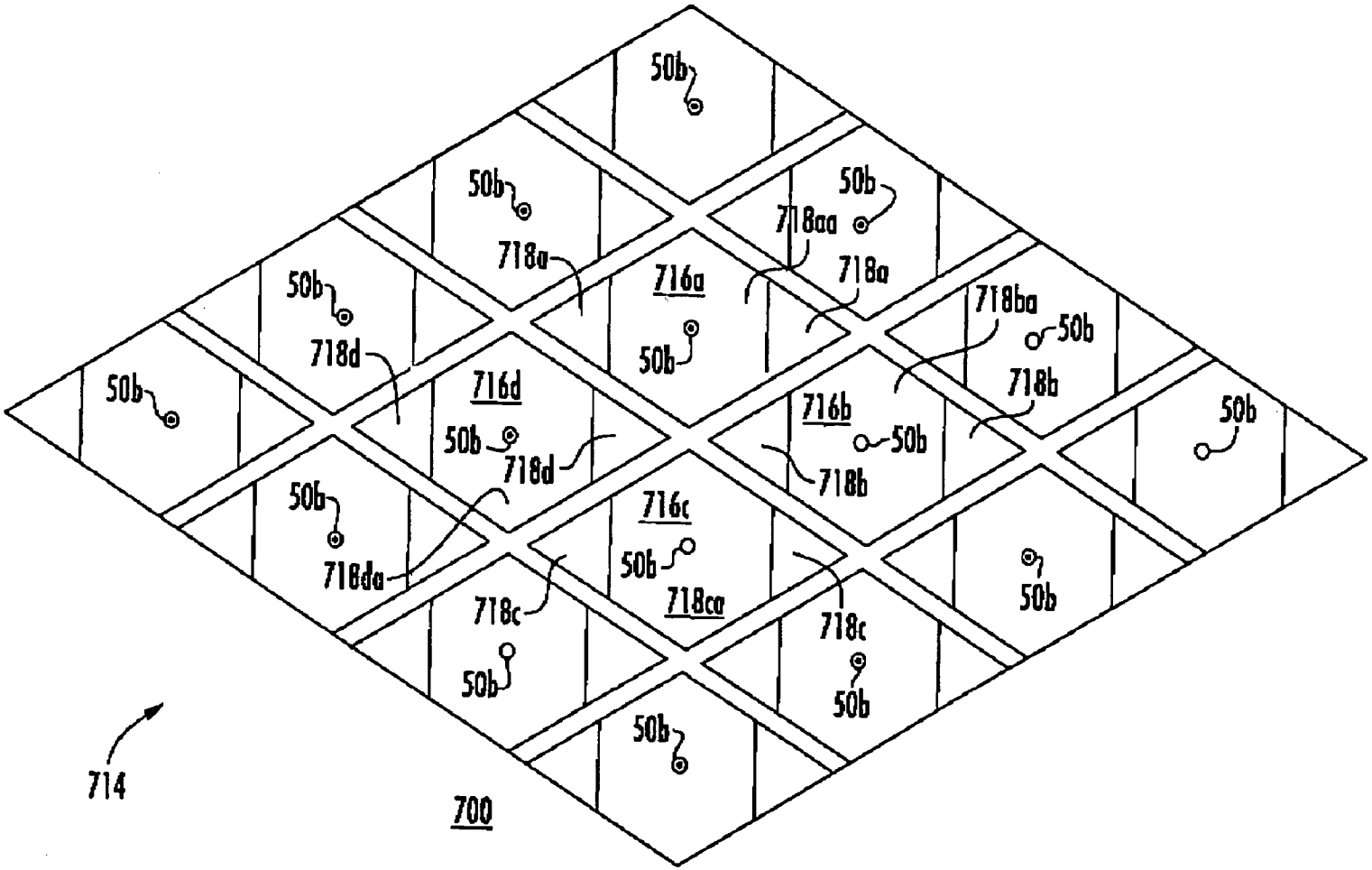
FIG. 7*d* is a plan view of an array tile centered on the elements of the staggered array of FIG. 7*c*, showing the diamond-shaped aperture which fills the area.

As mentioned, the antenna element 10 of FIG. 1, while usable in itself, is primarily intended for use in an array. In an array, it is advantageous for area efficiency to fill the available area with radiating elements. FIG. 7*a* illustrates a pattern of dots 710 representing the centers of the radiating apertures of a regular array, and FIG. 7*b* illustrates a portion of an array of rectangular apertures 712*a*, 712*b*, 712*c*, and 712*d* which together completely fill the array. FIG. 7*c* is a set of dots 714 arrayed in staggered fashion, and FIG. 7*d* is a plan view of a subarray or "tile" illustrating a portion of a set of sixteen diamond-shaped apertures which together completely fill the available area. In FIG. 7*d*, the staggered dots of array or set 714 of FIG. 7*c* appear at the centers of the thermally conductive rods 50*b* of each aperture. More particularly, representative apertures 716*a*, 716*b*, 716*c*, and 716*d* of FIG. 7*d* show electrically conductive layers 718*a*, 718*b*, 718*c*, and, 718*d*, respectively, corresponding to conductive layer 18 of FIG. 1. Each of conductive layers 718*a*, 718*b*, 718*c*, and 718*d* of representative apertures 716*a*, 716*b*, 716*c*, and 716*d*, respectively, shows its hexagonal aperture 718*aa*, 718*ba*, 718*ca*, and 718*da*, respectively, corresponding to aperture 18*a* of FIG. 1. It will be clear from FIG. 7*d* that the apertures centered on the staggered array 714 completely fill the aperture of the tile (except for unavoidable separations between apertures), and that the apertures are diamond-shaped. The particular aspect ratio or ratio of the major to minor diameter or axis of each aperture, and of the tile, is about 1.7:1.

It is well know that an electric field cannot exist adjacent a conductive wall which is parallel with the field. FIG. 8*a* illustrates the electric field distribution 812 in a rectangular aperture such as that defined by an open rectangular waveguide 810, and FIG. 8*b* is a sinusoidal representation 814 of the field distribution intensity, which has a magnitude of zero at the right and left edges. FIG. 8*c* represents the electric field distribution 818 in a diamond-shaped aperture 816. Distribution 820 of FIG. 8*d* represents a plot of the field intensity of FIG. 8*c*. As can be seen, the field intensity has a nonzero value at the right and left extremes. Thus, the diamond-shaped radiating patch 12 of FIGS. 1 and 6 has a field distribution which tends to fill the available aperture, making better use of the space.

The arrangement of the apertures of FIG. 7*b* has the E walls of the apertures adjacent each other, which tends to maximize mutual coupling in at least one direction of the array, and very little coupling between adjacent elements in the H direction. By contrast, the diamond-shaped apertures of FIG. 7*d* have more-or-less equal coupling for both the E- and H-planes. Thus, diamond-shaped radiating apertures exhibit a lesser magnitude of mutual coupling, and are more suitable to a staggered array pattern than are rectangular apertures. It will be appreciated that in this context, the diamond-shaped patch antenna 12 of FIGS. 1 and 6 is the "radiating aperture."

Figure 9:
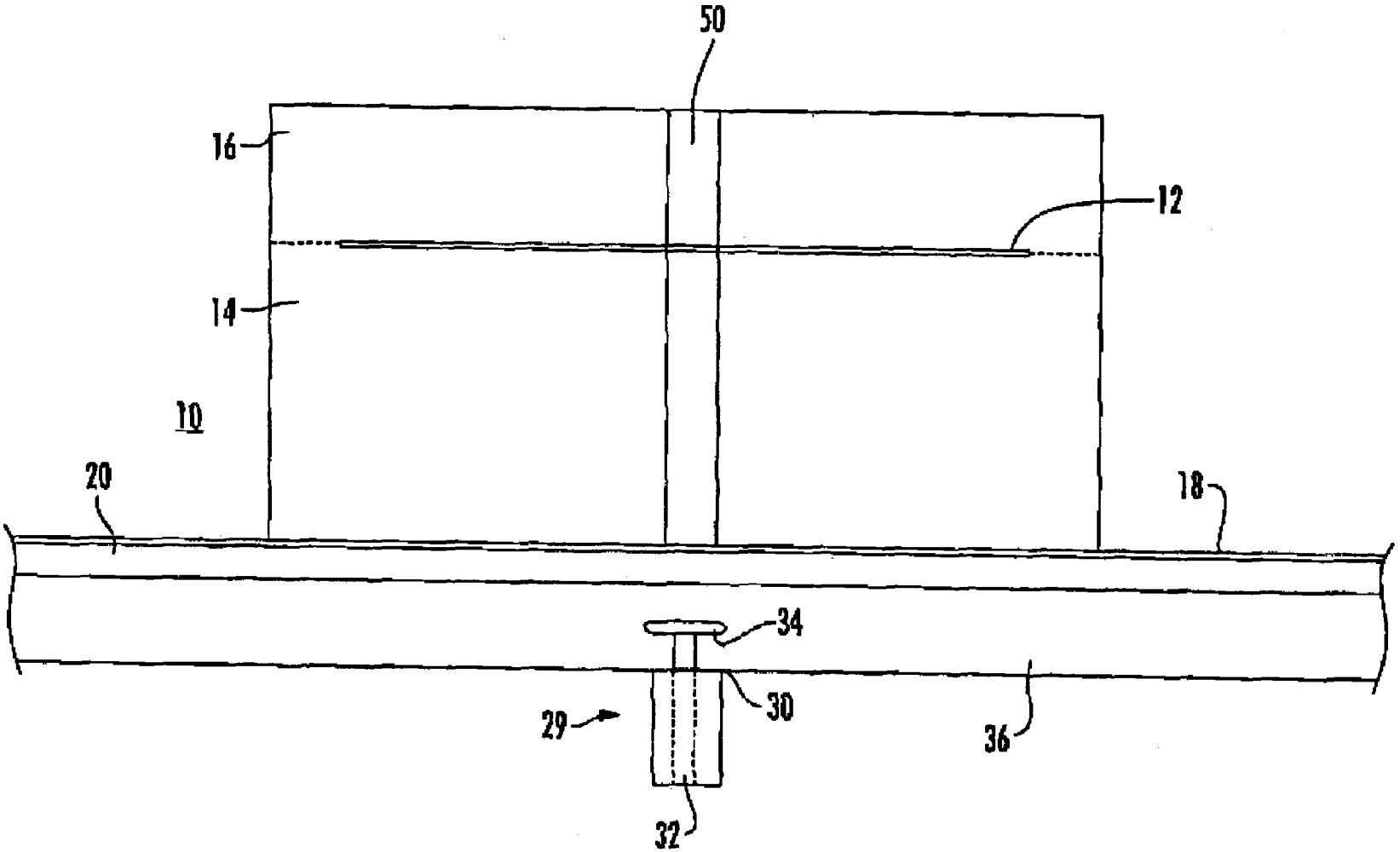
FIG. 9 is an elevation cross-sectional view showing the spacing of the radiating patch of an antenna element according to an aspect of the invention above the foreshortened waveguide and the slot, and also showing the thermal distribution layer.
Figure 10:
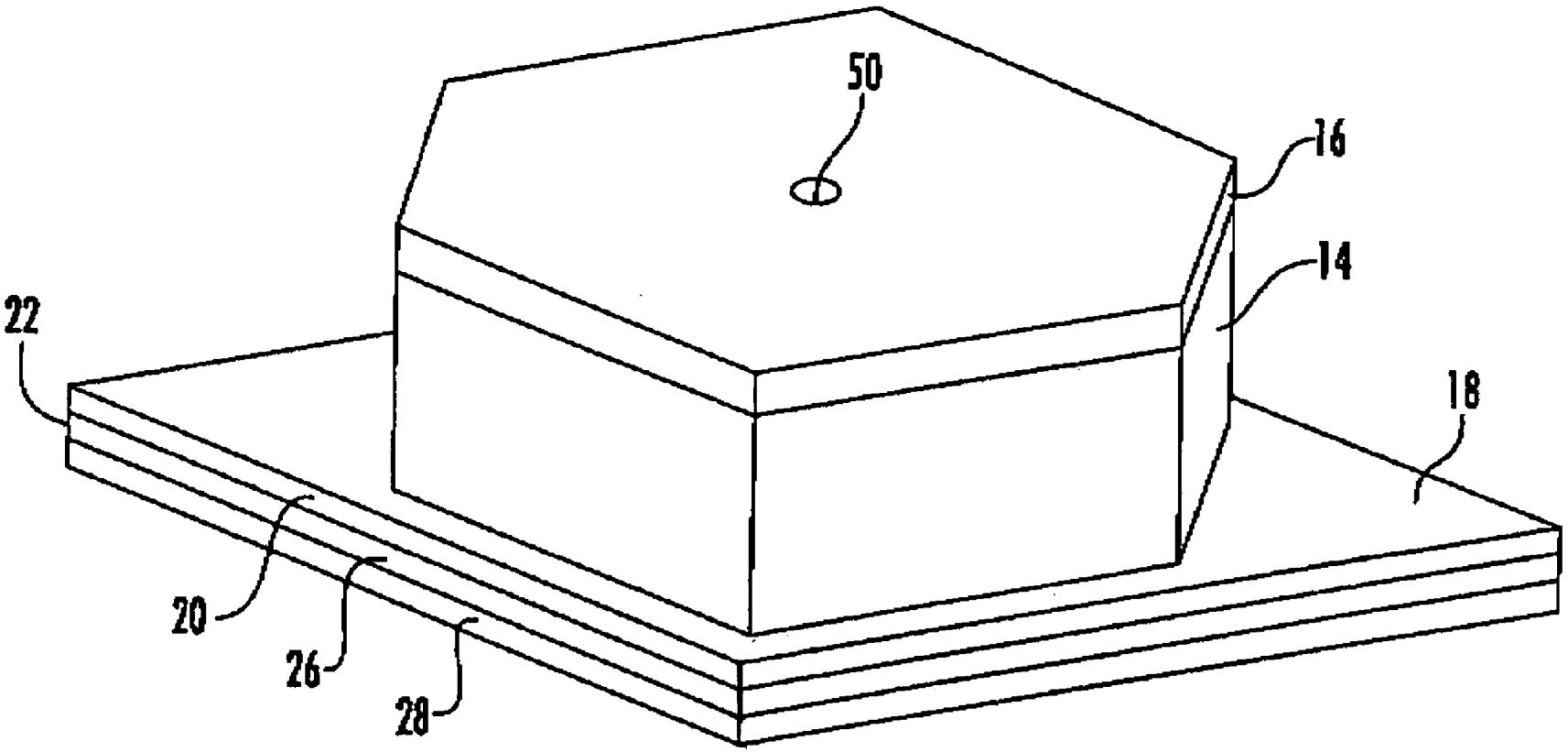
FIG. 10 is a perspective or isometric view of an individual antenna element of an array.

FIG. 9 is an elevation cross-sectional view, showing the spacing of the radiating patch of an antenna element 10 above the stripline 36 with its slot 40, and also showing the thermal distribution layer 18. FIG. 10 is a perspective or isometric view of an individual antenna element of an array, with the various layers designated by alphanumerics corresponding to those of FIG. 1.

Figure 11:
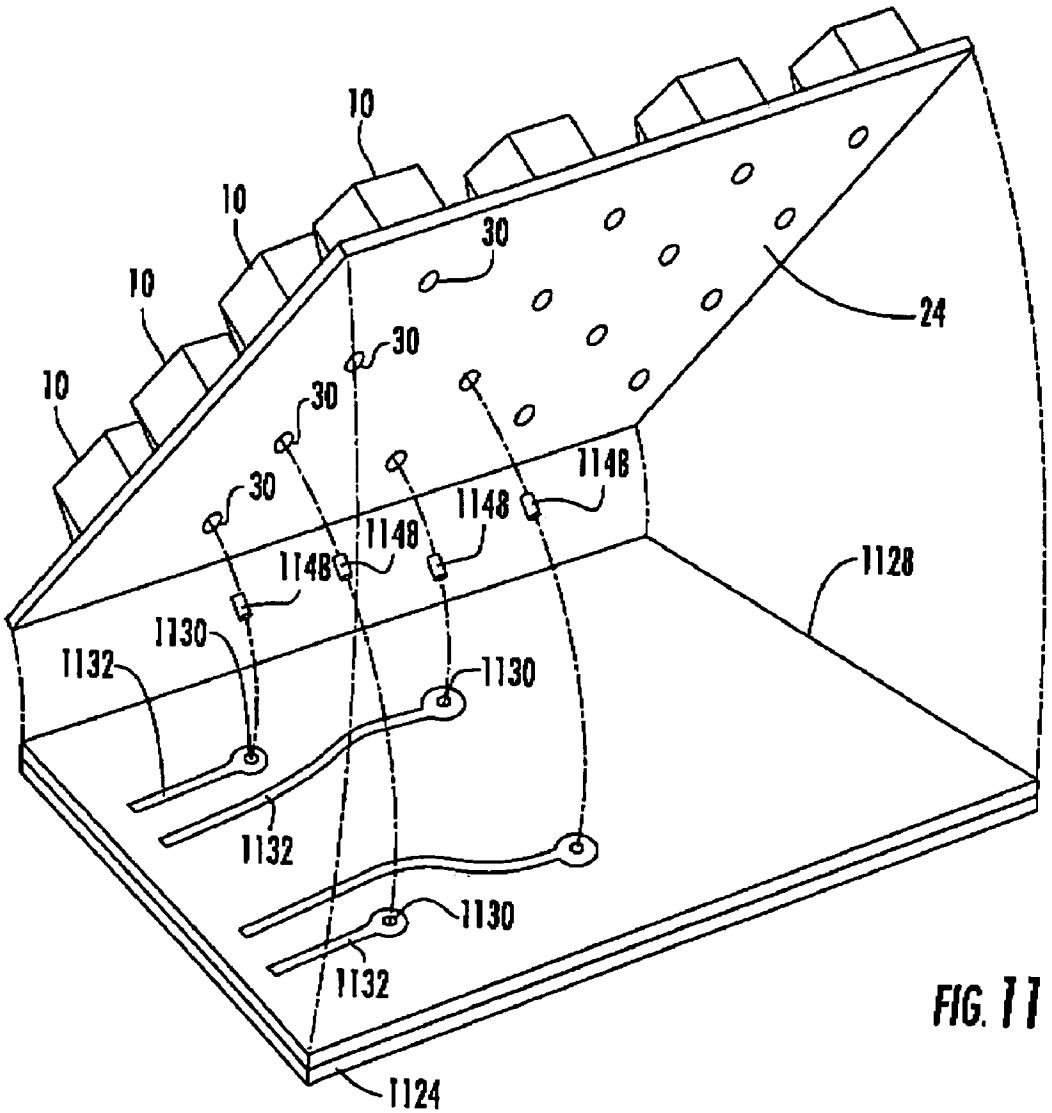
FIG. 11 is a God's-eye view of an array of antenna elements with stripline feed points connected by vias to further feed conductors on a further dielectric layer.

FIG. 11 illustrates an alternative method for feeding the individual antenna elements 10 of an array of antenna elements such as those of FIG. 1. In FIG. 10, lower ground plane 24 defines a feed aperture 30 adjacent each antenna element 10. A further dielectric layer 1128 bears conductive traces, some of which are designated 1132, extending on the near or upper surface 1128*us* of dielectric layer 1128 to points or locations 1130, which are registered with apertures 30 of layer 24 when dielectric layer 1128 and ground layer 24 are juxtaposed. These locations are those at which through via metallizations, illustrated as 1148, extend from the ends of the conductive traces 1132 through corresponding apertures 30 to make contact with the feed strip 34 of each antenna element 10. Thus, easily fabricated, low cost, low weight feed connections can be made by bulk processes, rather than requiring the hand labor of assembling a coaxial connector for each antenna element.

Figure 12:
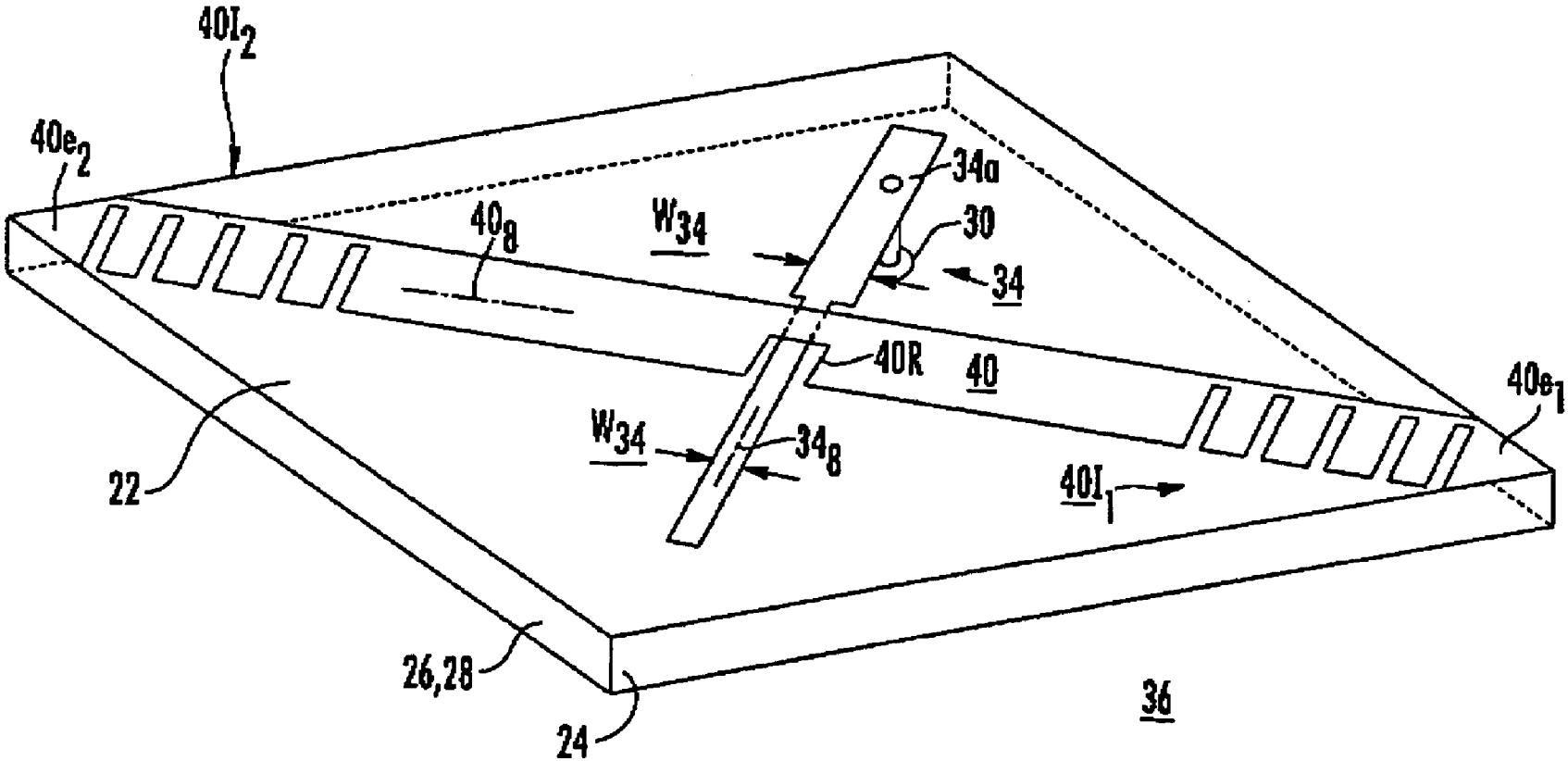
FIG. 12 is a perspective or isometric view of the stripline portion of an antenna element according to an aspect of the invention, in which the strip conductor has multiple widths for impedance transformation purposes.

In one embodiment of an antenna element according to an aspect of the invention, the input impedance at the feed point 34*a* was found to be about 22 ohms, somewhat low for direct connection to a conventional 50-ohm transmission line. According to this aspect of the invention, the feed strip 34 of FIG. 1 provides impedance transformation. FIG. 12 is a simplified perspective or isometric view of an alternate embodiment of the stripline portion 36 of the antenna element of FIG. 1. In FIG. 12, the axis or direction of elongation $\mathbf{40}_8$ of slot 40 lies orthogonal to the axis or direction of elongation $\mathbf{34}_8$ of strip conductor 34. As illustrated, strip conductor 34 has two distinct widths, namely large width $W_{34}$ and smaller width $W_{34}$. The length of the portion of width $W_{34}$ is selected to be equal to one quarter wavelength ($\lambda/4$) near the center of the operating frequency band. The portion of width $W_{34}$ is selected to have a characteristic impedance about equal to the square root of 22×50, or about 35 ohms.

Thus, an antenna according to an aspect of the invention comprises a first generally planar conductive piece (28) defining a feed aperture (30), and a second generally planar conductive piece (22) defining an elongated slot (40). The first (28) and second (22) generally planar pieces are spaced apart and electrically conjoined, as by a set of through vias, along a closed path. A feed strip (34) lies between the first and second generally planar conductive pieces and extends to the feed aperture (30) for being fed thereat, to thereby define a stripline (36). The direction of elongation of the feed strip (34) extends orthogonal to the direction of elongation of the slot (40) for exciting the slot and generating an electric field thereacross. A generally planar conductive third layer (18) defines an elongated strip (18*s*). The conductive third layer (18) is mounted adjacent the slot (40), and spaced therefrom, with the direction of elongation of the strip (18*s*) parallel with the direction of elongation of the slot (40). A generally planar patch antenna (12) is mounted near the conductive strip (18*s*), with the plane of the patch antenna (12) parallel with the planes of the first (28) and second (22) generally planar conductive pieces. A radome (60) is located adjacent to, but not necessarily in contact with, the patch antenna (12). A thermally conductive rod (50*a*, 50*b*) extends from the conductive strip (18*s*) toward and through the patch antenna (12), and extends above the patch antenna (12) by an amount selected to make contact with the radome (60). In one embodiment, the elongated strip (18*s*) of the third layer (18) is thermally conductive, and in another embodiment, the elongated strip (18*s*) of the third layer (18) is electrically conductive. In a preferred embodiment, the elongated strip (18*s*) of the third layer (18) is both thermally and electrically conductive. The radome (60) may be supported away from the patch antenna (12) by a dielectric element (14, 16). In a version preferred for bandwidth, the elongated slot (40) in the second generally planar conductive piece (22) is ridged (40R). For broadbanding, the elongated slot (40) in the second generally planar conductive piece (22) is digitated (FIGS. 3*b*, 3*c*) or interdigitated (FIG. 3*a*). In general, the digitation or interdigitation is near an end (40*e*) of the slot (40), and preferably near both ends (40*e*1, 40*e*2) of the slot (40), and remote from the center region of the slot (40).

An antenna according to another aspect of the invention comprises a generally planar electrically conductive patch radiator (12) defining a radiating side (12R) and an other side (12*o*), and a generally planar electrically conductive layer (22) adjacent, but not contacting, the other side (12*o*). The electrically conductive layer (22) defines an elongated aperture (40), for exciting the patch radiator (12) with linearly polarized energy. A radome (60) is juxtaposed with the radiating side (12R) of the patch radiator (12). A thermally conductive, planar layer (18) extends generally parallel with the patch radiator (12) and the electrically conductive layer (22) at a location lying between the patch radiator (12) and the electrically conductive layer (22), and not in contact with either the patch radiator (12) or the electrically conductive layer (22). The thermally conductive layer (18) includes an elongated strip thermal conductor (18*s*) extending parallel with the elongated aperture (40), and in thermal communication with a heat sink (18, 48, 22). An elongated thermally conductive member (50*a*, 50*b*) extends perpendicular to the plane of the patch radiator (12), and defines first (50*e*$_1$) and second (50*e*$_2$) ends. The first end (50*e*$_2$) of the thermally conductive member (50*a*, 50*b*) is in thermal communication with the strip thermal conductor (18*s*) of the thermally conductive planar layer (18). The thermally conductive member (50*a*, 50*b*) extends through the patch radiator (14), and has the second end (50*e*$_1$) of the thermally conductive member (50*a*, 50*b*) in thermal contact with the radome (60). In a particular embodiment of this embodiment, the thermally conductive member is a rod. In another hypostasis of the invention, the antenna further comprises a hollow waveguide (66) attached to the electrically conductive layer (22), for feeding the patch radiator (12) from the elongated aperture (40). The planar patch radiator (12) is generally rectangular, and more specifically may be generally diamond-shaped. The radome (60) may be in actual contact with the patch radiator (12), or may be separated from the patch radiator (12) by at least one layer (16) of foam dielectric material. The elongated aperture (40) in the generally planar electrically conductive layer (22) defines first (40$_1$) and second (40$_2$) straight, elongated, mutually parallel sides, and in a broadband version the elongated aperture (40) further defines at least one digitation (40I$_1$) in which a first digit protrudes from one of the first and second straight, elongated, mutually parallel sides toward the other one of the first and second straight, elongated, mutually parallel sides. The one digitation (40I$_1$) of the elongated aperture (40) may lie adjacent a first end (40*e*$_1$) of the elongated aperture. The elongated aperture (40) may further define a second digitation (40I$_2$) in which a finger protrudes from the one of the first and second straight, elongated, mutually parallel sides toward the other one of the first and second straight, elongated, mutually parallel sides adjacent a second end (40*e*$_2$) of the elongated aperture. In yet a further version, the one digitation (40I$_1$) in which a first digit (40*d*1) protrudes from one of (40$_2$) the first (40$_2$) and second (40$_1$) straight, elongated, mutually parallel sides toward the other one (40$_1$) of the first (40$_2$) and second (40$_1$) straight, elongated, mutually parallel sides includes a further digit (40*d*2) protruding from the other one (40$_1$) of the first (40$_2$) and second (40$_1$) straight, elongated, mutually parallel sides toward the one (40$_2$) of the first (40$_2$) and second (40$_1$) straight, elongated, mutually parallel sides at a location lying adjacent the first digit (40*d*1), to thereby define an interdigitation (40I$_1$). This interdigitation (40I$_1$) lies near an end (40*e*$_1$) of the elongated aperture (40). In a second avatar of this aspect of the invention, a second interdigitation (40I$_2$) lies near an other end (40*e*$_2$) of the elongated aperture (40). The antenna elements as described may be incorporated into an array of antenna elements, in which the conductive layers extend over several adjacent elements, and in which the radome, if applicable, also extends over several adjacent elements.

An array antenna (700) according to another aspect of the invention includes a generally side-by-side array of antenna elements (10), each of which antenna elements (10) comprises:

a first generally planar conductive piece (28) defining a feed aperture (30), and a second generally planar conductive piece (22) defining an elongated slot (40). The first (28) and second (22) generally planar pieces are spaced apart and electrically conjoined (as by vias 38). A feed strip (34) lies between the first (28) and second (22) generally planar conductive pieces and extends to the feed aperture (30) for being fed thereat. The feed strip (34) extends orthogonal to the slot (40) for generating an electric field across the slot. A generally planar conductive third layer (18) defines an elongated strip (18*s*). The conductive third layer (18) is mounted adjacent the slot (40), and spaced therefrom, with the direction of elongation of the strip (18*s*) parallel with the direction of elongation (40$_8$) of the slot (40). A generally planar patch radiator (12) is mounted near, but not in contact with, the conductive strip (18*s*), with the plane of the patch radiator (12) parallel with the planes of the first (28) and second (22) generally planar conductive pieces. A radome (60) is located adjacent to, but not necessarily in contact with, the patch radiator (12). A thermally conductive rod (50) extends from the conductive strip (18*s*) toward and through the patch radiator (12), and extending above the patch radiator (12) by an amount selected to make contact with the radome (60).

In this array antenna, (a) the first generally planar conductive piece (28), (b) the second generally planar conductive piece (22), (c) the generally planar conductive third layer (18), and (d) the radome (60) are common to all antenna elements of the array.

An antenna according to a further manifestation of the invention comprises a generally planar electrically conductive patch radiator (12) defining a radiating side (12R) and an other side (12*o*), and also comprises a generally planar electrically conductive layer (22) adjacent, but not contacting, the other side (12*o*) of the patch radiator (12). The electrically conductive layer (22) defines an elongated aperture (40), for exciting the patch radiator (12) with energy flowing through the elongated aperture (40) in the electrically conductive layer (22). The elongated aperture (40) defines first (40$_2$) and second (40$_1$) generally straight, mutually parallel sides and first (40*e*$_1$) and second (40*e*$_2$) ends. The elongated aperture (40) further defines digitation (40I$_1$) adjacent at least the first end (40*e*$_1$) of the elongated aperture (40). The digitation includes a first finger (40*d*1) extending from the first side (40$_2$) of the elongated aperture (40) toward the second side (40$_1$) of the elongated aperture (40), but not making contact with the second side ($40_1$) of the elongated aperture (40). In a particular version of this manifestation, the digitation is part of an interdigitation. The interdigitation further includes a second finger (40*d*2) extending from the second side ($40_1$) of the elongated aperture (40) toward the first side ($40_2$) of the elongated aperture (40), but not making contact with the first side ($40_2$) of the elongated aperture (40). The first (40*d*1) and second (40*d*2) fingers lie adjacent each other.

What is claimed is:

1. An antenna, comprising:

a first generally planar conductive piece defining a feed aperture;

a second generally planar conductive piece defining an elongated slot, said first and second generally planar pieces being spaced apart and electrically conjoined along a closed path;

a feed strip lying between said first and second generally planar conductive pieces and extending to said feed aperture for being fed thereat, to thereby define a stripline, said feed strip extending orthogonal to said slot for exciting said slot and generating an electric field thereacross;

a generally planar conductive third layer defining an elongated strip, said conductive third layer being mounted adjacent said slot, and spaced therefrom, with the direction of elongation of said strip parallel with the direction of elongation of said slot;

a generally planar patch antenna, said patch antenna being mounted near said conductive strip, with the plane of said patch antenna parallel with the planes of said first and second generally planar conductive pieces;

a radome located adjacent to, but not necessarily in contact with, said patch antenna;

a thermally conductive rod extending from said conductive strip toward and through said patch antenna, and extending above said patch antenna by an amount selected to make contact with said radome.

2. An antenna according to claim 1, wherein said elongated strip of said third layer is thermally conductive.

3. An antenna according to claim 2, wherein said elongated strip of said third layer is electrically conductive.

4. An antenna according to claim 1, wherein said elongated strip of said third layer is both thermally and electrically conductive.

5. An antenna according to claim 1, wherein said radome is supported away from said patch antenna by a dielectric element.

6. An antenna according to claim 1, wherein said elongated slot in said second generally planar conductive piece is ridged.

7. An antenna according to claim 1, wherein said elongated slot in said second generally planar conductive piece is digitated.

8. An antenna according to claim 7, wherein said elongated slot in said second generally planar conductive piece is interdigitated.

9. An antenna according to claim 7, wherein said digitation of said elongated slot is near an end of said slot.

10. An antenna according to claim 7, wherein said digitation of said elongated slot is near both ends of said slot, and remote from the center region of said slot.

11. An antenna according to claim 1, wherein said feed strip defines separate regions of diverse widths.

12. An antenna, comprising:

a generally planar electrically conductive patch radiator defining a radiating side and an other side;

a generally planar electrically conductive layer adjacent, but not contacting, said other side, said electrically conductive layer defining an elongated aperture, for exciting said patch radiator with linearly polarized energy;

a radome juxtaposed with said radiating side of said patch radiator;

a thermally conductive, planar layer extending generally parallel with said patch radiator and said electrically conductive layer, at a location lying between said patch radiator and said electrically conductive layer, and not in contact with either said patch radiator or said electrically conductive layer, said thermally conductive layer including an elongated strip thermal conductor extending parallel with said elongated aperture, and in thermal communication with a heat sink; and an elongated thermally conductive member extending perpendicular to the plane of said patch radiator, and defining first and second ends, said first end of said thermally conductive member being in thermal communication with said strip thermal conductor of said thermally conductive planar layer, said thermally conductive member extending through said patch radiator, and having said second end of said thermally conductive member in thermal contact with said radome.

13. An antenna according to claim 12, wherein said thermally conductive member is a rod.

14. An antenna according to claim 12, further comprising a hollow waveguide attached to said electrically conductive layer, for feeding said patch radiator from said elongated aperture.

15. An antenna according to claim 12, wherein said planar patch radiator is generally rectangular.

16. An antenna according to claim 12, wherein said planar patch radiator is generally diamond-shaped.

17. An antenna according to claim 12, wherein said radome is separated from said patch radiator by at least one layer of foam dielectric material.

18. An antenna according to claim 12, wherein said elongated aperture in said generally planar electrically conductive layer defines first and second straight, elongated, mutually parallel sides.

19. An antenna according to claim 18, wherein said elongated aperture further defines at least one digitation in which a first digit protrudes from one of said first and second straight, elongated, mutually parallel sides toward the other one of said first and second straight, elongated, mutually parallel sides.

20. An antenna according to claim 19, wherein said one digitation of said elongated aperture lies adjacent a first end further defines a second digitation in which a finger protrudes from said one of said first and second straight, elongated, mutually parallel sides toward the other one of said first and second straight, elongated, mutually parallel sides adjacent a second end of said elongated aperture.

21. An antenna according to claim 19, wherein said one digitation in which a first digit protrudes from one of said first and second straight, elongated, mutually parallel sides toward the other one of said first and second straight, elongated, mutually parallel sides includes a further digit protruding from the other one of said first and second straight, elongated, mutually parallel sides toward said one of said first and second straight, elongated, mutually parallel sides at a location lying adjacent said first digit, to thereby define an interdigitation.

22. An antenna according to claim 21, wherein said interdigitation lies near an end of said elongated aperture.

23. An antenna according to claim 21, further comprising a second interdigitation, said second interdigitation lying near an other end of said elongated aperture.

24. An array antenna, said array antenna comprising a generally side-by-side array of antenna elements, each of said antenna elements comprising:

a first generally planar conductive piece defining a feed aperture;

a second generally planar conductive piece defining an elongated slot, said first and second generally planar pieces being spaced apart and electrically conjoined;

a feed strip lying between said first and second generally planar conductive pieces and extending to said feed aperture for being fed thereat, said feed strip extending orthogonal to said slot for generating an electric field across said slot;

a generally planar conductive third layer defining an elongated strip, said conductive third layer being mounted adjacent said slot, and spaced therefrom, with the direction of elongation of said strip parallel with the direction of elongation of said slot;

a generally planar patch radiator, said patch radiator being mounted near, but not in contact with, said conductive strip, with the plane of said patch radiator parallel with the planes of said first and second generally planar conductive pieces;

a radome located adjacent to, but not necessarily in contact with, said patch radiator;

a thermally conductive rod extending from said conductive strip toward and through said patch radiator, and extending above said patch radiator by an amount selected to make-contact with-said radome;

wherein (a) said first generally planar conductive, piece, (b) said second generally planar conductive piece, (c) said generally planar conductive third layer, and (d) said radome being common to all antenna elements of said array.

25. An antenna, comprising:

a generally planar electrically conductive patch radiator defining a radiating side and an other side;

a generally planar electrically conductive layer adjacent, but not contacting, said other side of said patch radiator, said electrically conductive layer defining an elongated aperture, for exciting said patch radiator with energy flowing through said elongated aperture in said electrically conductive layer, said elongated aperture defining first and second generally straight, mutually parallel sides and first and second ends, said elongated aperture further defining digitation adjacent at least said first end of said elongated aperture, said digitation including a first finger extending from said first side of said elongated aperture toward said second side of said elongated aperture, but not making contact with said second side of said elongated aperture.

26. An antenna according to claim 25, wherein said digitation is part of an interdigitation, said interdigitation further including a second finger extending from said second side of said elongated aperture toward said first side of said elongated aperture, but not making contact with said first side of said elongated aperture, said first and second fingers being lying adjacent each other.

* * * * *